US012405052B2

(12) United States Patent
Kwon et al.

(10) Patent No.: US 12,405,052 B2
(45) Date of Patent: Sep. 2, 2025

(54) REFRIGERATOR

(71) Applicant: SAMSUNG ELECTRONICS CO., LTD., Suwon-si (KR)

(72) Inventors: Juno Kwon, Suwon-si (KR); Sangmin Park, Suwon-si (KR); Jin Jeong, Suwon-si (KR); Yonghan Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 18/618,161

(22) Filed: Mar. 27, 2024

(65) Prior Publication Data

US 2024/0240851 A1 Jul. 18, 2024

Related U.S. Application Data

(63) Continuation of application No. 17/349,353, filed on Jun. 16, 2021, now Pat. No. 11,982,488.

(30) Foreign Application Priority Data

Jun. 17, 2020 (KR) ..... 10-2020-0073553
Feb. 10, 2021 (KR) ..... 10-2021-0019141

(51) Int. Cl.
*F25D 23/12* (2006.01)
*F25D 23/04* (2006.01)

(52) U.S. Cl.
CPC ..... *F25D 23/126* (2013.01); *F25D 23/04* (2013.01); *F25D 2323/122* (2013.01)

(58) Field of Classification Search
CPC .. F25D 23/126; F25D 23/04; F25D 2323/122; F25D 2700/00
See application file for complete search history.

(56) References Cited

U.S. PATENT DOCUMENTS

2009/0038330 A1 2/2009 Lee et al.
2015/0197417 A1 7/2015 Stagg et al.
(Continued)

FOREIGN PATENT DOCUMENTS

CN 102818423 A 12/2012
CN 203595335 U 5/2014
(Continued)

OTHER PUBLICATIONS

International Search Report for International Patent Application No. PCT/KR2021/007332 dated Sep. 24, 2021.
(Continued)

*Primary Examiner* — Jerry-Daryl Fletcher
*Assistant Examiner* — Dario Antonio Deleon
(74) *Attorney, Agent, or Firm* — STAAS & HALSEY LLP

(57) ABSTRACT

A refrigerator including a main body having a storage compartment, a door rotatably provided on the main body to open and close the storage compartment, and an automatic water supply device. The automatic water supply device includes a water supply case, a bucket detachably mounted on the water supply case, and a water level sensor provided to detect a water level in the bucket, and is configured to supply water to the bucket depending on the water level in the bucket. The door includes a dyke protruding from a rear surface of the door to form an accommodation space in which the water supply case is accommodated, and the water supply case is coupled to the dyke.

15 Claims, 18 Drawing Sheets

(56) References Cited

U.S. PATENT DOCUMENTS

| | | | |
|---|---|---|---|
| 2016/0290707 | A1 | 10/2016 | Burket et al. |
| 2017/0137277 | A1 | 5/2017 | Comsa et al. |
| 2018/0187964 | A1* | 7/2018 | Park et al. ..... F25D 23/02 |
| 2018/0209718 | A1 | 7/2018 | Staud et al. |

FOREIGN PATENT DOCUMENTS

| | | | |
|---|---|---|---|
| CN | 205619678 | U | 4/2016 |
| CN | 107036380 | A | 8/2017 |
| DE | 102017212734 | B4 | 2/2020 |
| EP | 3 438 580 | A1 | 2/2019 |
| JP | 2004-177068 | A | 6/2004 |
| KR | 20-1999-0001879 | | 1/1999 |
| KR | 100783236 | B1 | 12/2007 |
| KR | 10-2010-0000237 | A | 1/2010 |
| KR | 10-2010-0033494 | A | 3/2010 |
| KR | 10-2014-0116092 | | 10/2014 |
| KR | 20-0478717 | | 11/2015 |
| KR | 10-1816551 | | 1/2018 |
| KR | 20180009475 | A | 1/2018 |
| KR | 10-2018-0031177 | | 3/2018 |
| KR | 101838812 | B1 | 3/2018 |
| KR | 10-2018-0080056 | | 7/2018 |
| KR | 10-2019-0126635 | A | 11/2019 |
| WO | WO 2011/093567 | A1 | 8/2011 |
| WO | WO 2019113403 | A1 | 6/2019 |

OTHER PUBLICATIONS

Office Action dated Oct. 17, 2022 in U.S. Appl. No. 17/349,353.
Primula Beverage System (Year: 2012).
Primula Beverage System NPL with "date first available" (Year: 2012).
Office Action dated Apr. 7, 2023 in U.S. Appl. No. 17/349,353.
Office Action dated Jul. 14, 2023 in No. U.S. Appl. No. 17/349,353.
Extended European Search Report dated May 11, 2023 in European Patent Application No. 21825310.2.
Notice of Allowance dated Jan. 19, 2024 in U.S. Appl. No. 17/349,353.
U.S. Appl. No. 17/349,353, filed Jun. 16, 2021, Juno Kwon et al., Samsung Electronics Co., Ltd.
Intention to grant dated Nov. 21, 2024 for European Patent Application No. 21 825 310.2.
Extended European Search Report issued Jun. 11, 2025 for Application No. 25165212.9.

* cited by examiner

REFRIGERATOR

CROSS-REFERENCE TO RELATED APPLICATION(S)

This application is a continuation application of U.S. patent application Ser. No. 17/349,353, filed on Jun. 16, 2021, which is based on and claims priority under 35 U.S.C. § 119 to Korean Patent Application No. 10-2020-0073553, filed on Jun. 17, 2020, and Korean Patent Application No. 10-2021-0019141, filed on Feb. 10, 2021, in the Korean Intellectual Property Office, the disclosures of which are incorporated by reference herein in their entirety.

BACKGROUND

1. Field

The disclosure relates to a refrigerator, and more particularly, to a refrigerator having an automatic water supply device that automatically supplies water to a bucket when the bucket is mounted.

2. Description of the Related Art

A refrigerator is a home appliance including a main body having a storage compartment and a cold air supply device for supplying cold air to the storage compartment to keep food fresh.

A refrigerator may be provided with a dispenser configured to allow a user to receive water from the outside of the refrigerator by operating an operating lever without opening a door. However, the dispenser may discharge water only while the user depresses the operating lever. Therefore, the user may not receive a large amount of water at once and is required to keep pressing the operating lever until water collects in a bucket when the user needs a large amount of water.

When the bucket is mounted in a bucket mounting space, an automatic water supply device may detect a water level in the bucket and supply water to fill the bucket with a predetermined amount of water.

SUMMARY

In accordance with an aspect of the disclosure, a refrigerator includes a main body having a storage compartment, a door rotatably provided on the main body to open and close the storage compartment, and an automatic water supply device including a water supply case, a bucket detachably mounted on the water supply case, and a water level sensor provided to detect a water level in the bucket, the automatic water supply device being configured to supply water to the bucket depending on the water level in the bucket, wherein the door includes a dyke protruding from a rear surface of the door to form an accommodation space in which the water supply case is accommodated, and the water supply case is coupled to the dyke.

The dyke may include a dyke bead protruding toward the accommodation space, and the water supply case may include a case bead groove formed such that the dyke bead is inserted.

The refrigerator may further include a fastening member provided to fasten the water supply case to the dyke in a state in which the dyke bead is inserted into the case bead groove.

The dyke may include an upper dyke part, a lower dyke part, and opposite side dyke parts forming an upper surface, a lower surface, and opposite side surfaces of the accommodation space, respectively, and the fastening member may include a first fastening member provided to fasten the water supply case to one of the opposite side dyke parts, and a second fastening member provided to fasten the water supply case to the lower dyke part.

The refrigerator may further include a door basket provided on the rear surface of the door to store food, wherein the water supply case may support the door basket so that the door basket is positioned at one side of the water supply case.

The door basket may include a basket bead groove formed on one side of the door basket, and the water supply case may include a case bead protruding from the water supply case to support the door basket by being inserted into the basket bead groove.

The case bead may be formed on a first surface of the water supply case, and the case bead groove may be formed on a second surface opposite to the first surface of the water supply case.

The water supply case may include a main case including a bucket mounting space in which the bucket is mounted, and a bucket support formed below the bucket mounting space to support the bucket, and a tray provided at a lower portion of the main case to collect water flowing out of the bucket.

The tray may include a drain hole provided to discharge water collected in the tray to the outside, and a plug provided to open and close the drain hole.

The main case may include a stopper of a rubber material provided on an upper side of the bucket mounting space to reduce the movement of the bucket supported by the bucket support.

The refrigerator may further include a water supply flow path provided to guide water supplied from a water supply source to the bucket, and a control valve provided to open and close the water supply flow path depending on the water level in the bucket detected by the water level sensor.

The automatic water supply device may further include a fitting member connected to the water supply flow path to guide water supplied from the water supply flow path to the bucket, and the fitting member may be disposed on an upper surface of the main case to pass through a water outlet hole formed on the main case.

The automatic water supply device may further include a check valve installed inside the fitting member to check for clogging and leak of the water supply flow path.

The check valve may include a valve housing installed inside the fitting member and having a valve flow path therein, and a valve body movably disposed inside the valve flow path to open and close the valve flow path depending on a pressure in the water supply flow path.

In accordance with an aspect of the disclosure, a refrigerator includes a main body having a storage compartment, a door rotatably provided on the main body to open and close the storage compartment, a door basket provided on a rear surface of the door to store food, and an automatic water supply device including a water supply case provided on the rear surface of the door, a bucket detachably mounted on the water supply case, and a water level sensor provided to detect a water level in the bucket, the automatic water supply device being configured to supply water to the bucket depending on the water level in the bucket, wherein the water supply case supports the door basket so that the door basket is positioned at one side of the water supply case.

The door basket may include a basket bead groove formed on one side of the door basket, and the water supply case may include a case bead protruding from the water supply case to support the door basket by being inserted into the basket bead groove.

In accordance with an aspect of the disclosure, a refrigerator includes a main body having a storage compartment, a door rotatably provided on the main body to open and close the storage compartment, and an automatic water supply device including a water supply case, a bucket detachably mounted on the water supply case, and a water level sensor provided to detect a water level in the bucket, the automatic water supply device being configured to supply water to the bucket depending on the water level in the bucket, wherein the bucket includes a bucket body having a bucket space provided to store water and a bucket opening formed on an upper side thereof to be in communication with the bucket space, an infuser provided to accommodate and brew tea leaves, and an infuser mount detachably coupled to the bucket opening to support the infuser.

The infuser mount may include a mount frame including a mount opening into which the infuser is inserted and an elastic hook elastically coupled to the bucket opening, and a mount handle protruding from the mount frame to be gripped by a user.

The infuser may include a sidewall having infuser holes formed to allow water to pass through, a bottom forming a space for accommodating tea leaves together with the sidewall, and an infuser rim protruding radially outward from an upper end of the sidewall to be supported on an upper surface of the mount frame.

The bucket may further include a bucket cover coupled to an upper portion of the bucket body, and the bucket body may include an inlet formed to allow water to be introduced into the bucket space, and a guide formed to be inclined to guide water introduced through the inlet toward the sidewall of the infuser.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Configurations shown in the embodiments and the drawings described in the present specification are only the preferred embodiments of the present disclosure, and thus it is to be understood that various modified examples, which may replace the embodiments and the drawings described in the present specification, are possible when filing the present application.

The singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that although the terms first, second, etc. may be used herein to describe various components, these components should not be limited by these terms, and the terms are only used to distinguish one component from another.

The terms "front end," "rear end," "upper portion," "lower portion," "upper end" and "lower end" used in the following description are defined with reference to the drawings, and the shape and position of each component are not limited by these terms.

It is an aspect of the disclosure to provide a refrigerator including an automatic water supply device capable of supplying water to a bucket until the bucket is filled with a predetermined amount of water when the bucket is mounted.

It is an aspect of the disclosure to provide a refrigerator including an automatic water supply device capable of being easily installed.

It is an aspect of the disclosure to provide a refrigerator including an automatic water supply device with improved usability, Hereinafter, embodiments of the disclosure will be described in detail with reference to the accompanying drawings.

Figure 1:
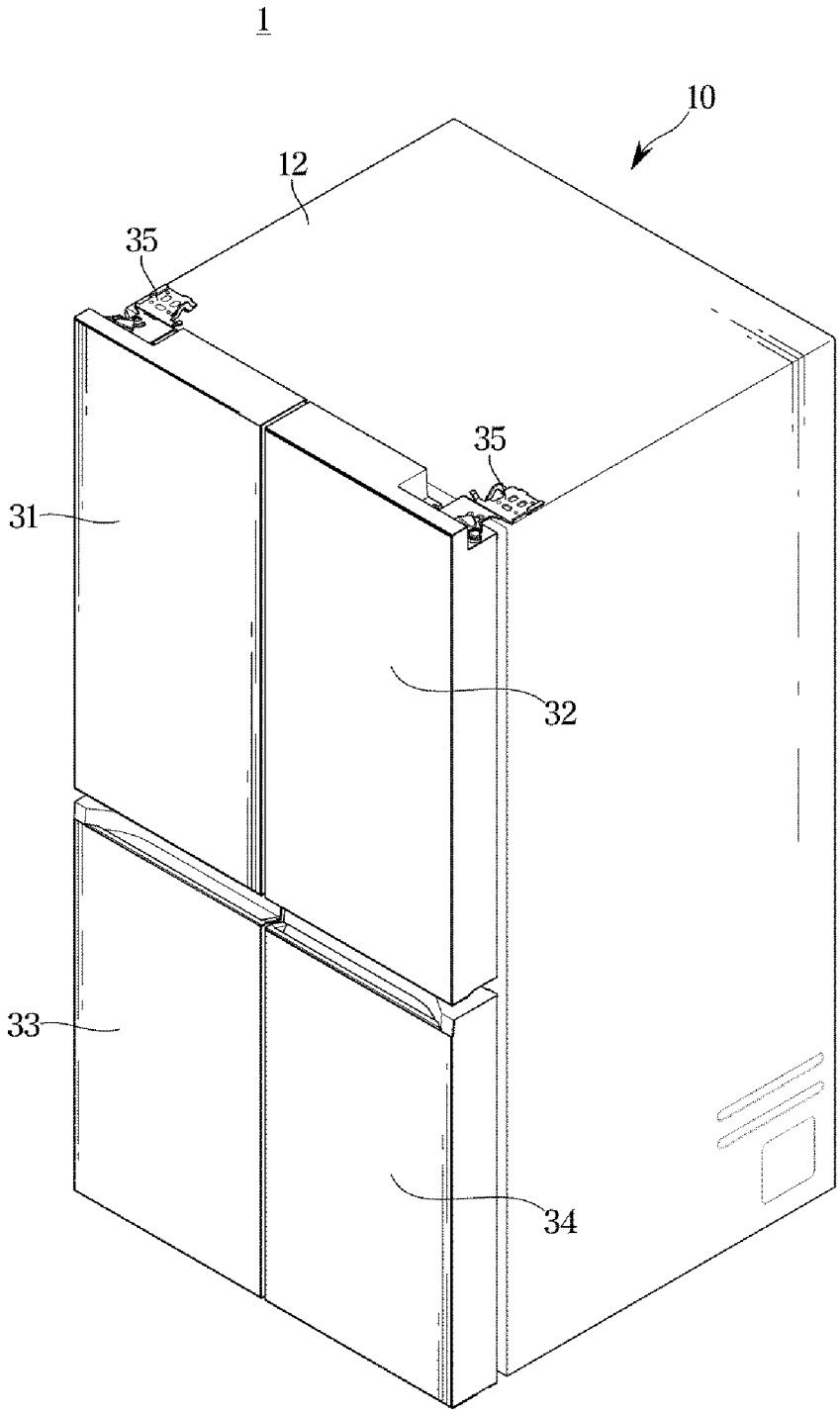
FIG. 1 is a perspective view illustrating an exterior of a refrigerator according to an embodiment of the disclosure.
Figure 2:
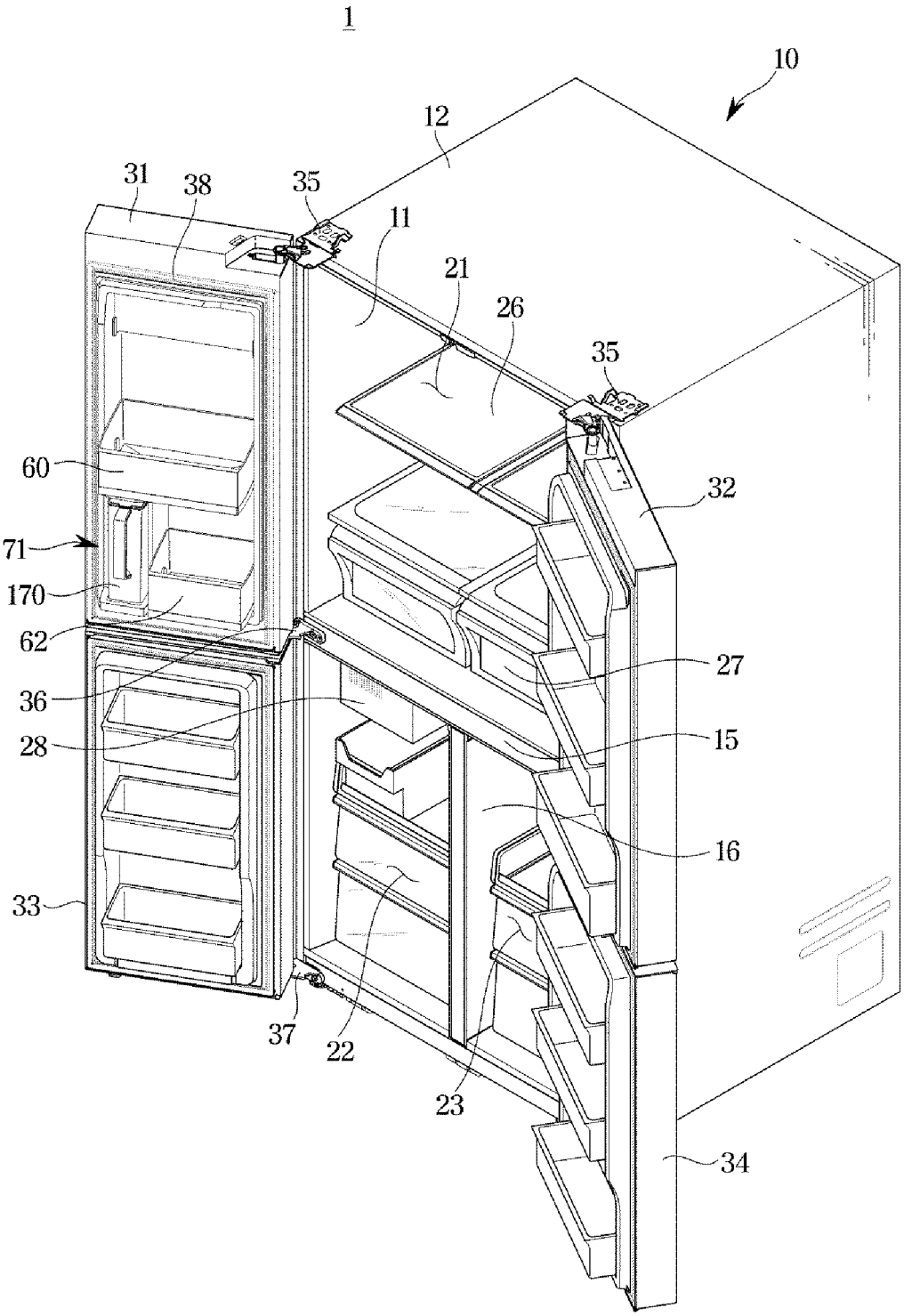
FIG. 2 is a perspective view illustrating a state in which doors of the refrigerator are opened according to an embodiment of the disclosure.
Figure 3:
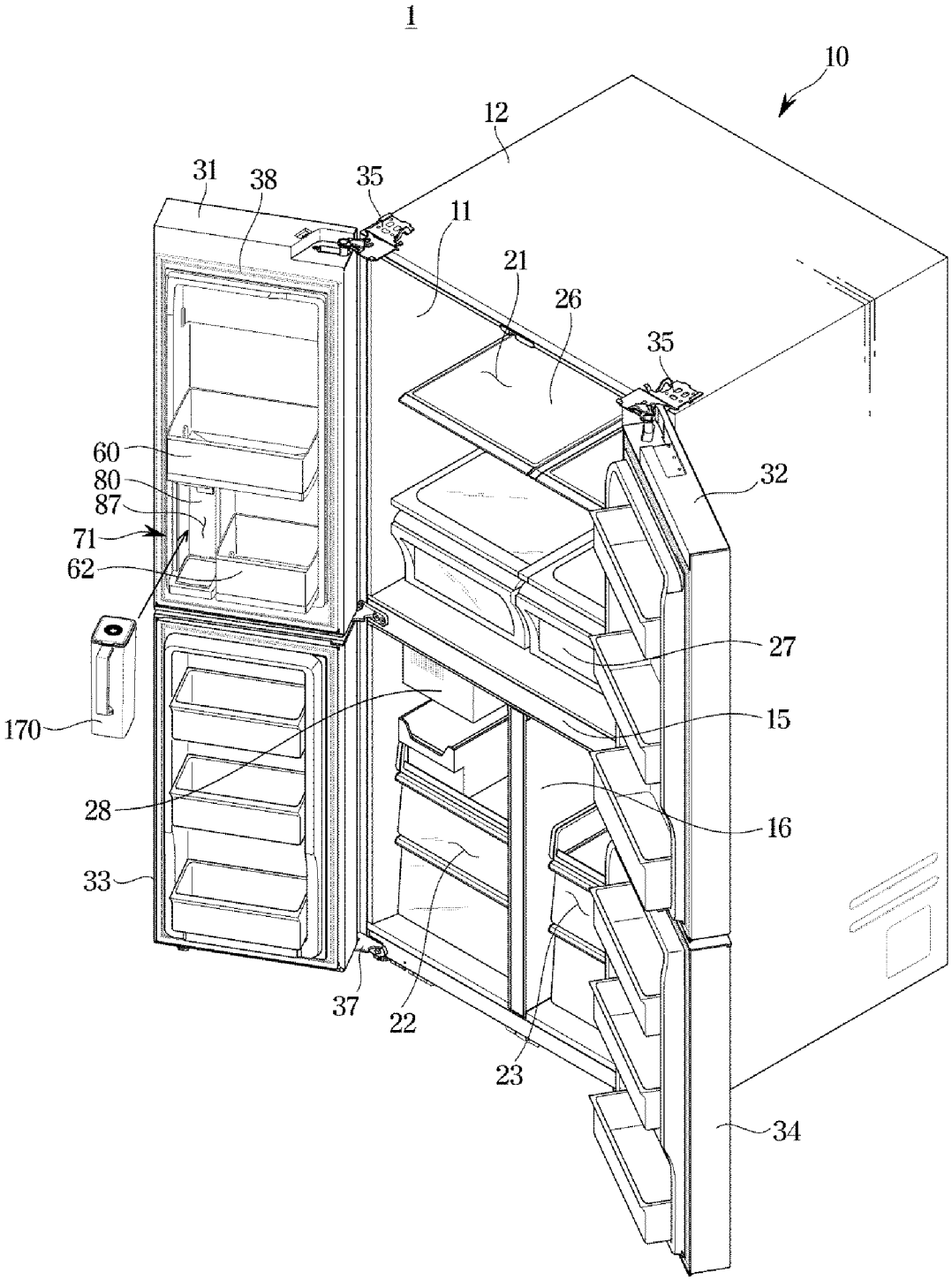
FIG. 3 is a perspective view illustrating a state in which a bucket is separated from an automatic water supply device of the refrigerator according to an embodiment of the disclosure.

FIG. 1 is a perspective view illustrating an exterior of a refrigerator according to an embodiment of the disclosure, FIG. 2 is a perspective view illustrating a state in which doors of the refrigerator are opened according to an embodiment of the disclosure, and FIG. 3 is a perspective view illustrating a state in which a bucket is separated from an automatic water supply device of the refrigerator according to an embodiment of the disclosure.

Referring to FIGS. 1 to 3, a refrigerator 1 according to an embodiment of the disclosure may include a main body 10, storage compartments 21, 22, and 23 formed inside the main body 10, doors 31, 32, 33, and 34 to open and close the storage compartments 21, 22, and 23, and a cold air supply device (not shown) to supply cold air to the storage compartments 21, 22, and 23.

The main body 10 may include an inner case 11 forming the storage compartments 21, 22, and 23, an outer case 12 coupled to the outside of the inner case 11 to form an outer appearance, and an insulation material (not shown) provided between the inner case 11 and the outer case 12 to insulate the storage compartments 21, 22, and 23.

A plurality of the storage compartments 21, 22, and 23 may be partitioned by a horizontal partition wall 15 and a vertical partition wall 16. The storage compartments 21, 22, and 23 may be partitioned into the upper storage compartment 21 and the lower storage compartments 22 and 23 by the horizontal partition wall 15, and the lower storage compartments 22 and 23 may be partitioned into the lower left storage compartment 22 and the lower right storage compartment 23 by the vertical partition wall 16.

The upper storage compartment 21 may be used as a refrigerating compartment, and the lower storage compartments 22 and 23 may be used as a freezing compartment. An ice maker 28 to make ice may be provided in either of the lower storage compartments 22 and 23. However, the division and use of the storage compartments 21, 22, and 23 as described above are only an example, and are not limited thereto.

Unlike the present embodiment, the refrigerator may be a side by side (SBS) type refrigerator in which storage compartments are partitioned into the left and right by a vertical partition wall, a French Door Refrigerator (FDR) in which storage compartments are partitioned into an upper storage compartment and a lower storage compartment by a horizontal partition wall, or a one-door type refrigerator having one storage compartment and one door.

A shelf 26 to place food and a storage container 27 to store food may be provided inside each of the storage compartments 21, 22, and 23.

The cold air supply device may generate cold air using a cold air circulation cycle through which a refrigerant is compressed, condensed, expanded, and evaporated, and may supply the generated cold air to the storage compartments 21, 22, and 23.

The upper storage compartment 21 may be opened and closed by a pair of the doors 31 and 32. Each of the doors 31 and 32 may be rotatably coupled to the main body 10 by an upper hinge 35 and an intermediate hinge 36. A filler (not shown) to prevent cold air in the storage compartment 21 from leaking between the pair of doors 31 and 32 when the pair of doors 31 and 32 are closed may be provided on one of the door 31 of the pair of doors 31 and 32.

The lower left storage compartment 22 may be opened and closed by the door 33, and the lower right storage compartment 23 may be opened and closed by the door 34. Each of the door 33 and the door 34 may be rotatably coupled to the main body 10 by the intermediate hinge 36 and a lower hinge 37.

A gasket 38 to be in close contact with a front surface of the main body 10 may be provided on a rear surface of each of the doors 31, 32, 33, and 34 to seal the storage compartments 21, 22, and 23. Each of the doors 31, 32, 33, and 34 may include door baskets 60 and 62 having a door storage space to store food. The door baskets 60 and 62 are provided on the rear surfaces of the doors 31, 32, 33, and 34 and may be cooled by cold air in the storage compartments 21, 22, and 23.

An automatic water supply device 71 may be provided on the rear surface of the door 31. The automatic water supply device 71 may include a water supply case 80 having a bucket mounting space 87, a bucket 170 detachably mounted in the bucket mounting space 87, and a water level sensor 130 (FIG. 6) to detect a water level in the bucket 170 mounted in the bucket mounting space 87. The automatic water supply device 71 may detect the water level in the bucket 170 mounted in the bucket mounting space 87 and supply water to the bucket 170 so that the bucket 170 is filled with a predetermined amount of water. That is, the automatic water supply device 71 may perform an auto-fill function.

Figure 4:
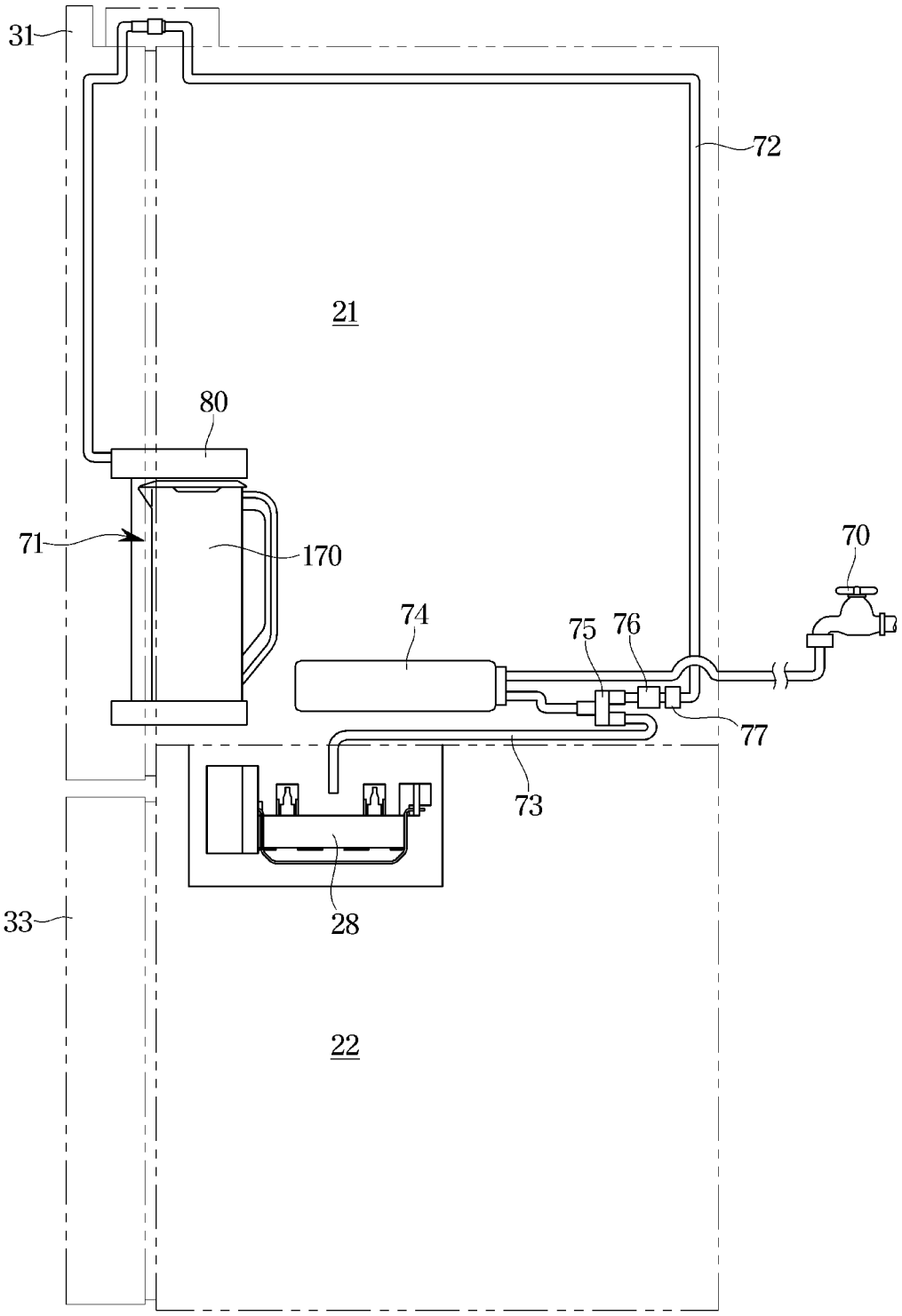
FIG. 4 is a schematic view illustrating a water supply flow path of the refrigerator according to an embodiment of the disclosure.

FIG. 4 is a schematic view illustrating a water supply flow path of the refrigerator according to an embodiment of the disclosure.

Referring to FIG. 4, the refrigerator 1 may include a water filter 74. The water filter 74 may purify water supplied from a water supply source 70.

The refrigerator 1 may include a water supply flow path 72 to guide water supplied from the water supply source 70 to the bucket 170 of the automatic water supply device 71, and an ice maker flow path 73 to guide the water supplied from the water supply source 70 to the ice maker 28.

The water supply flow path 72 and the ice maker flow path 73 are formed to branch at one point, and a flow path switching valve 75 may be provided at the branch point so that water supplied from the water supply source 70 is selectively supplied to the bucket 170 or the ice maker 28. Water in the water supply source 70 may be supplied to the bucket 170 or the ice maker 28 by a water pressure in the water supply source 70 and control of the flow path switching valve 75.

The water supply flow path 72 and the ice maker flow path 73 may be provided to extend from the water filter 74. Accordingly, water in the water supply source 70 may be purified by the water filter 74 and then supplied to the bucket 170 and the ice maker 28.

A control valve 76 may be provided on the water supply flow path 72. The control valve 76 may allow or block water supply from the water supply source 70 to the bucket 170. A flow sensor 77 is provided on the water supply flow path 72 to measure an amount of water supplied to the bucket 170.

Figure 5:
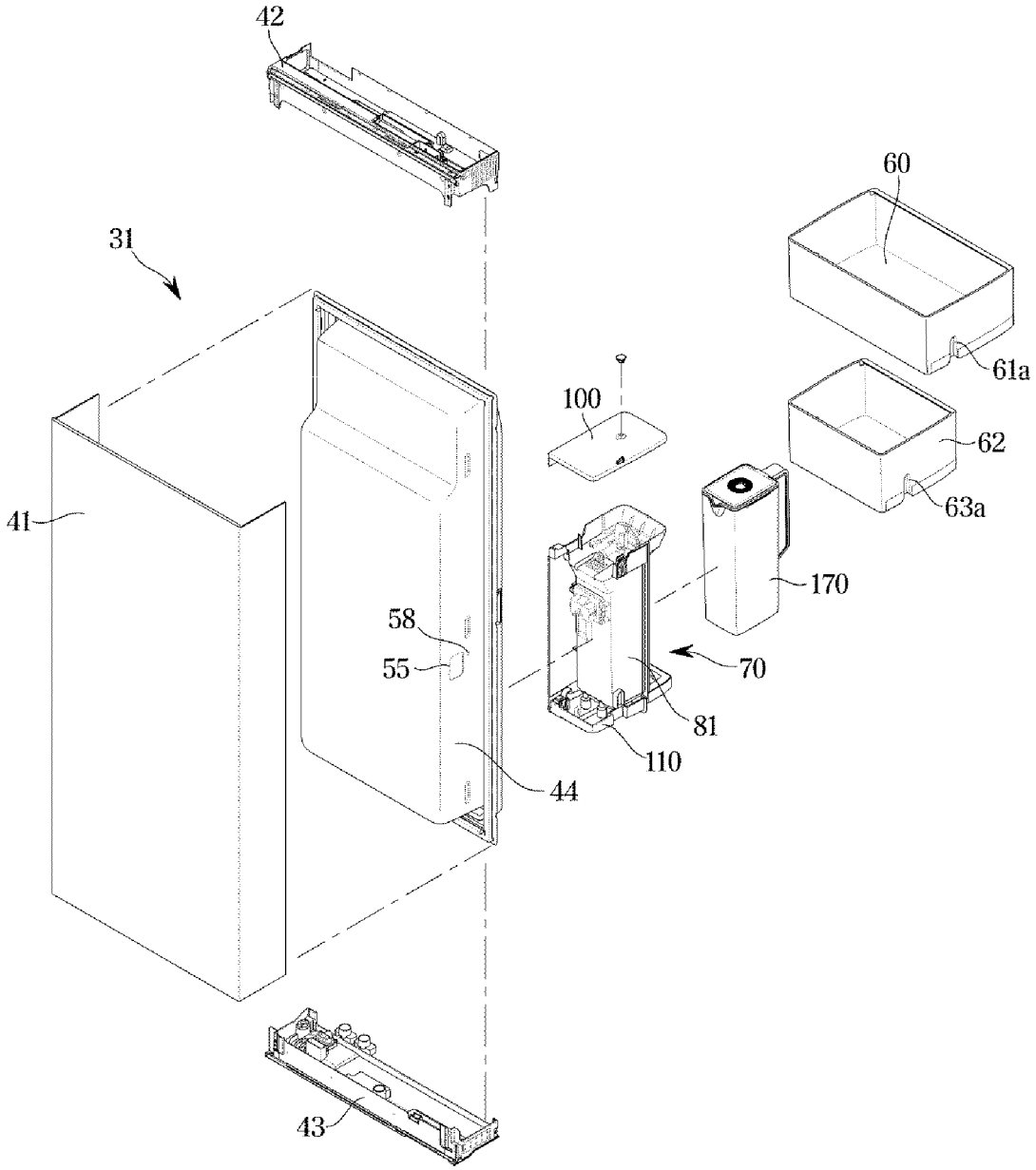
FIG. 5 is an exploded view illustrating the door and the automatic water supply device of the refrigerator according to an embodiment of the disclosure.
Figure 6:
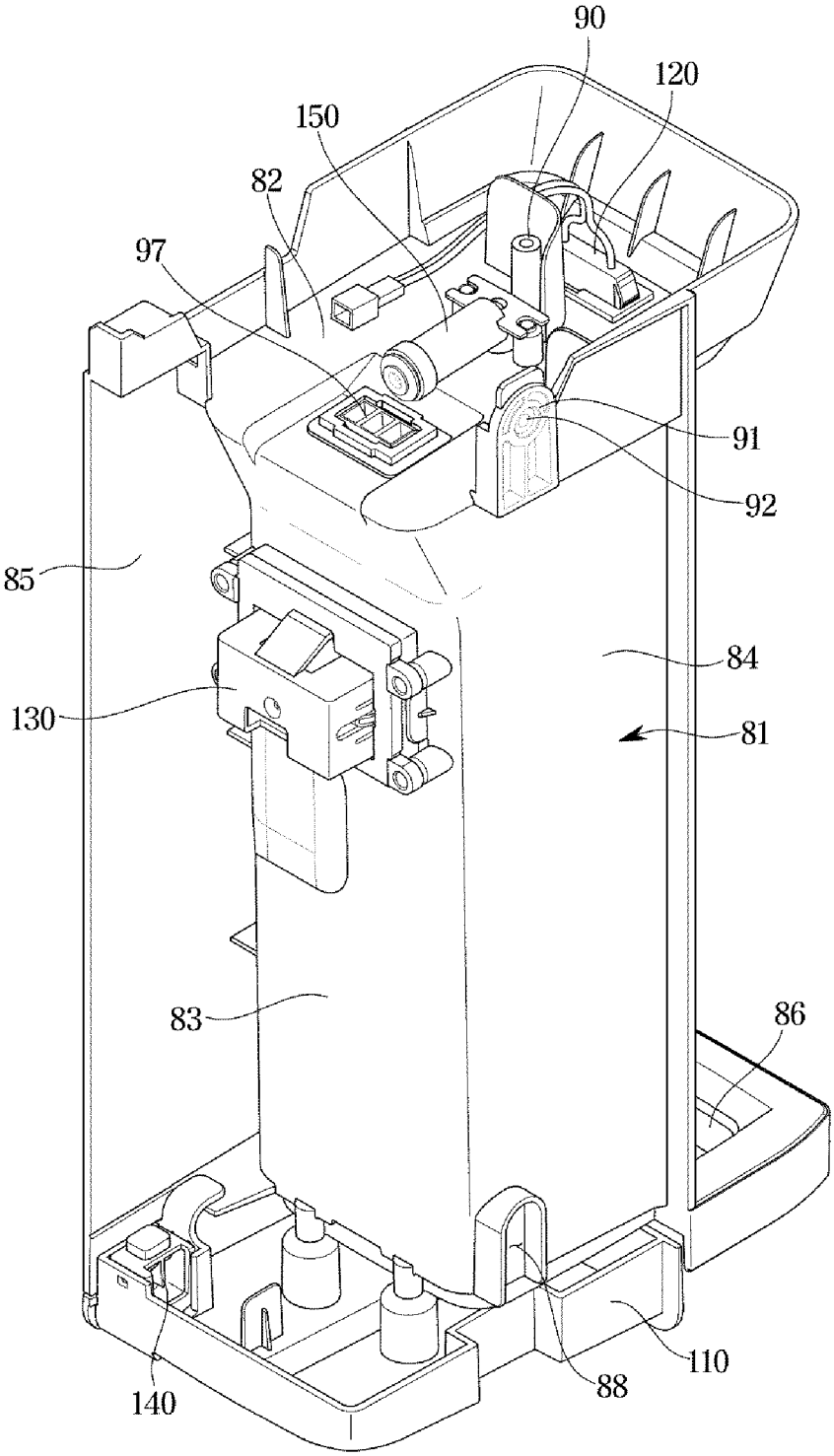
FIG. 6 is a perspective view illustrating a water supply case of the refrigerator according to an embodiment of the disclosure.
Figure 7:
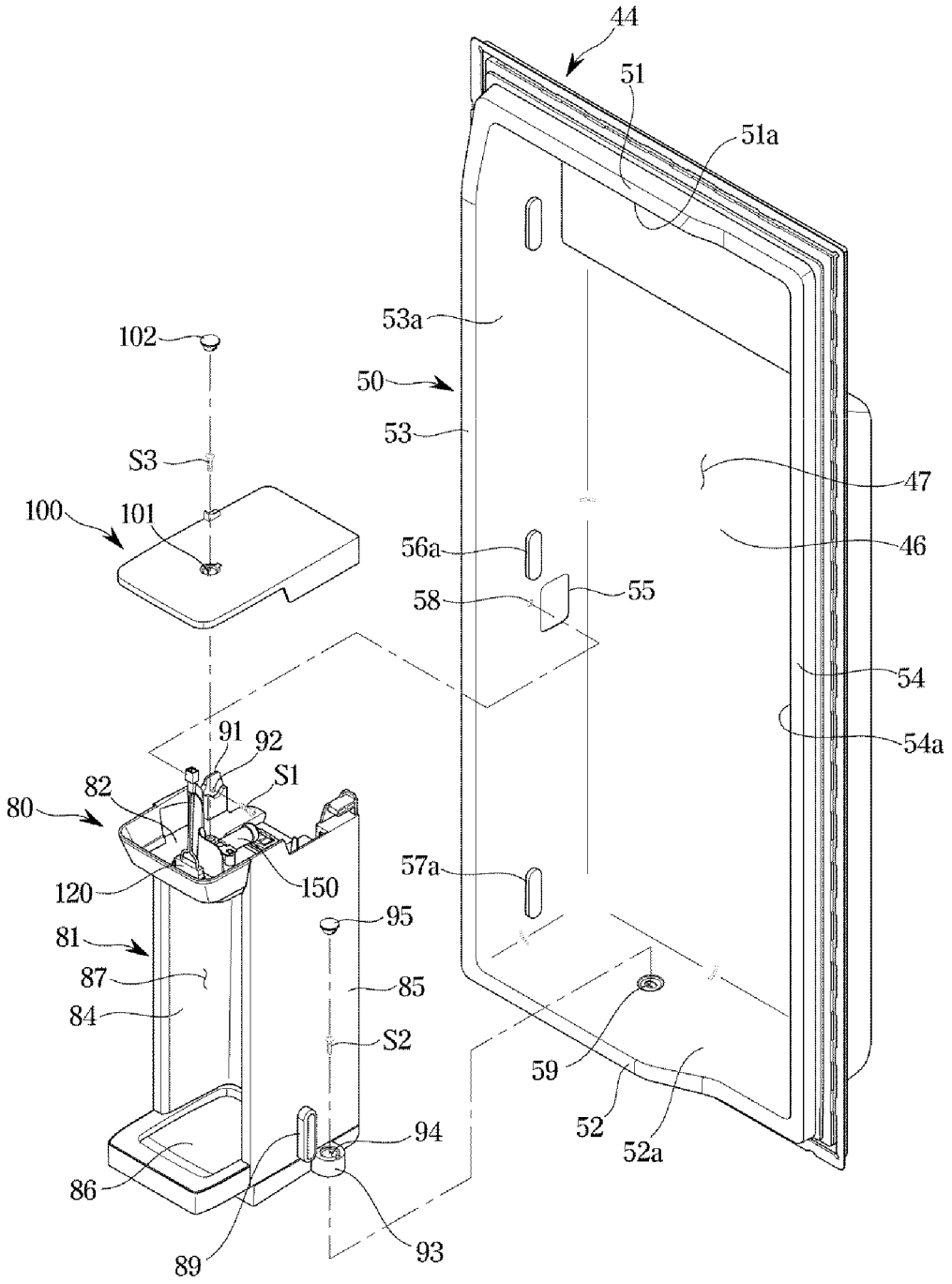
FIG. 7 is a view illustrating a coupling structure between the water supply case and the door of the refrigerator according to an embodiment of the disclosure.
Figure 8:
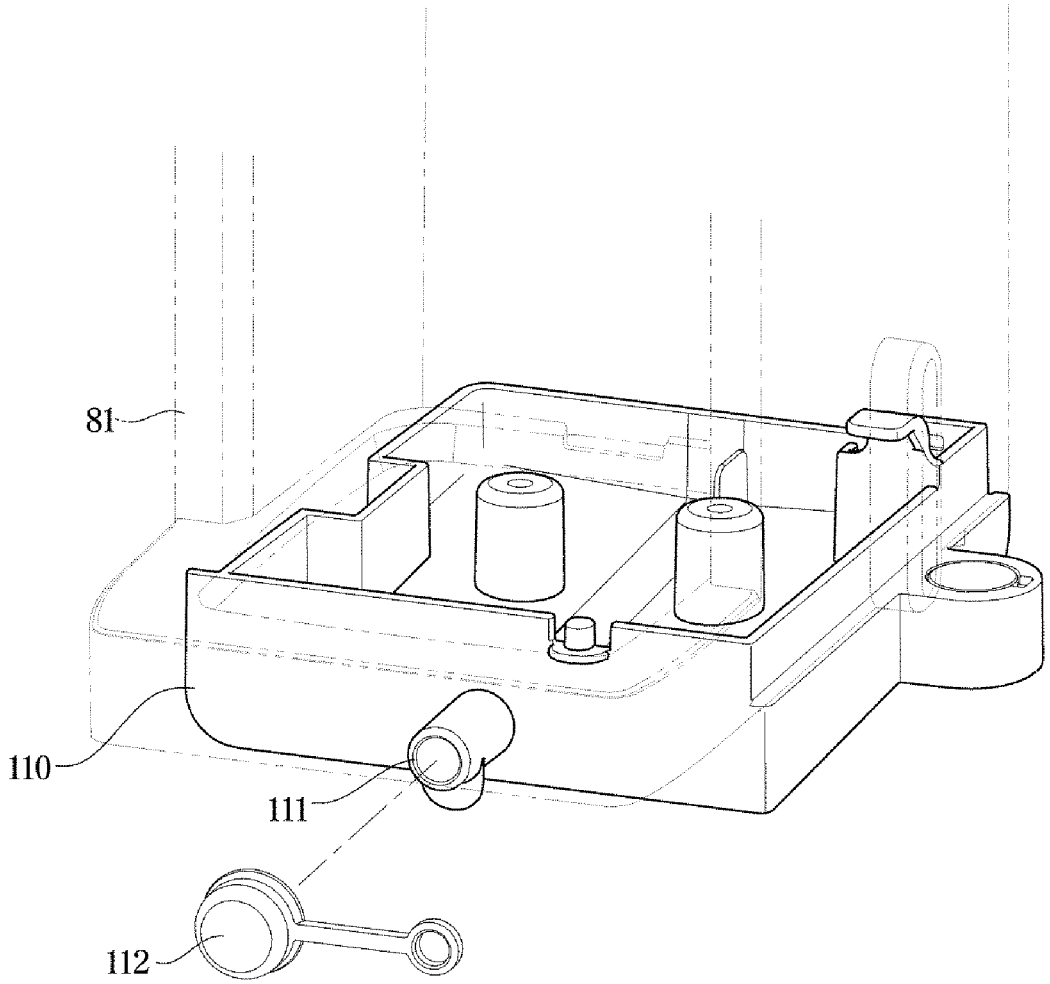
FIG. 8 is a view illustrating a tray of the water supply case of the refrigerator according to an embodiment of the disclosure.
Figure 9:
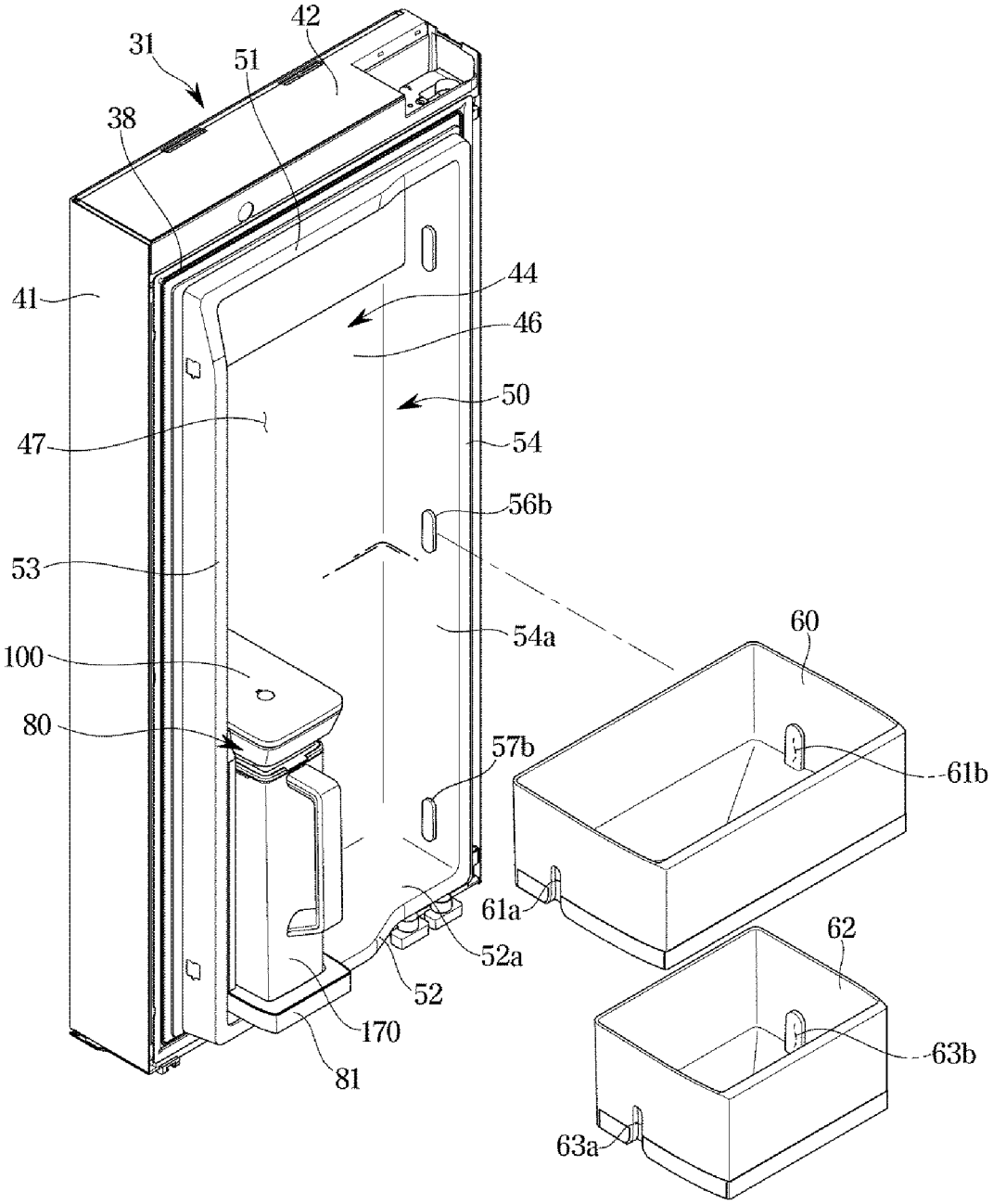
FIG. 9 is a view showing a coupling structure of a door basket of the refrigerator according to an embodiment of the disclosure.
Figure 10:
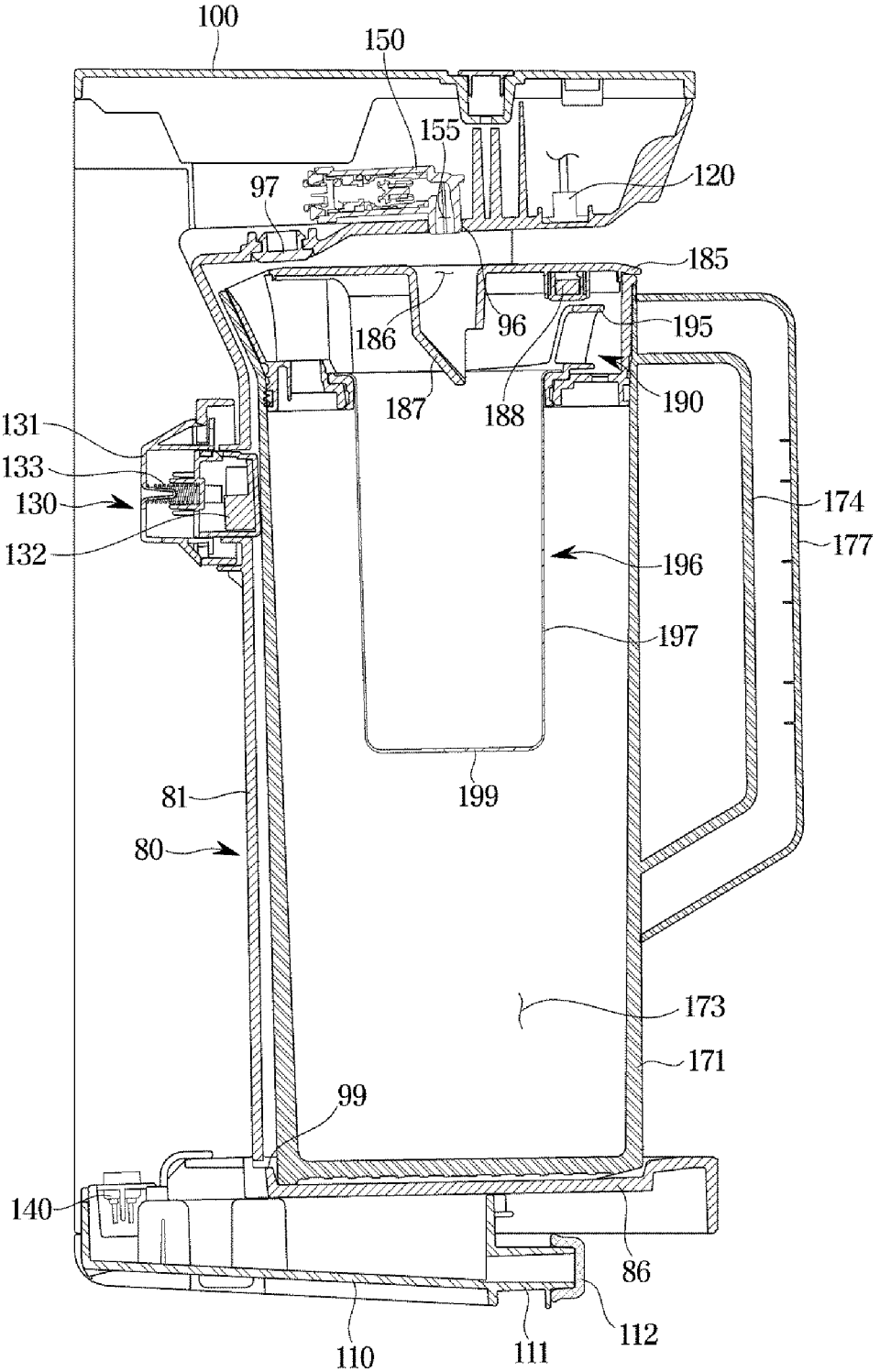
FIG. 10 is a side cross-sectional view of the automatic water supply device on which a bucket of the refrigerator according to an embodiment of the disclosure is mounted.
Figure 11:
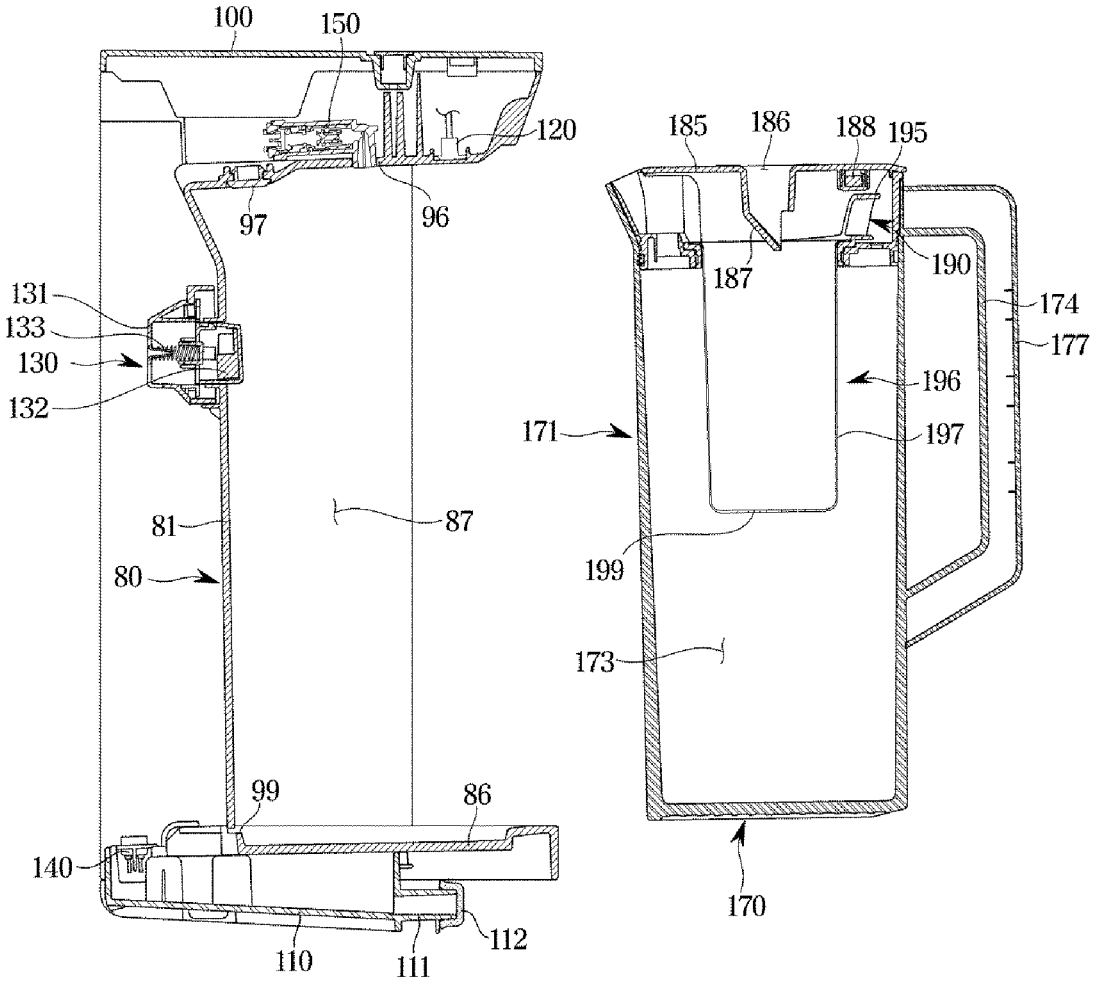
FIG. 11 is a side cross-sectional view of the automatic water supply device from which the bucket of the refrigerator according to an embodiment of the disclosure is separated.
Figure 18:
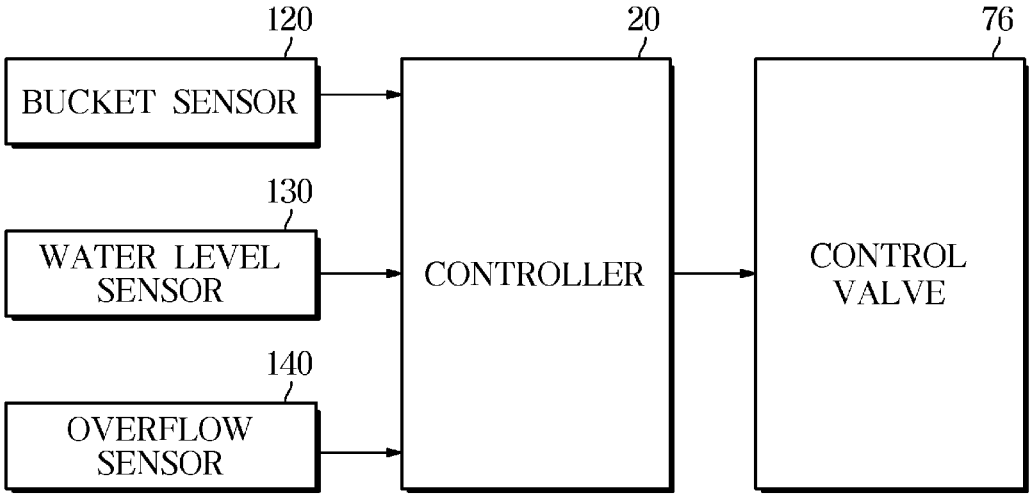
FIG. 18 is a control block diagram of the refrigerator according to an embodiment of the disclosure.

FIG. 5 is an exploded view illustrating the door and the automatic water supply device of the refrigerator according to an embodiment of the disclosure. FIG. 6 is a perspective view illustrating a water supply case of the refrigerator according to an embodiment of the disclosure. FIG. 7 is a view illustrating a coupling structure between the water supply case and the door of the refrigerator according to an embodiment of the disclosure. FIG. 8 is a view illustrating a tray of the water supply case of the refrigerator according to an embodiment of the disclosure. FIG. 9 is a view showing a coupling structure of a door basket of the refrigerator according to an embodiment of the disclosure. FIG. 10 is a side cross-sectional view of the automatic water supply device on which a bucket of the refrigerator according to an embodiment of the disclosure is mounted. FIG. 11 is a side cross-sectional view of the automatic water supply device from which the bucket of the refrigerator according to an embodiment of the disclosure is separated. FIG. 18 is a control block diagram of the refrigerator according to an embodiment of the disclosure.

In an embodiment of the disclosure, the automatic water supply device 71 is mounted on the door 31, but unlike this, the automatic water supply device 71 may be mounted on the another door 32 to open and close the refrigerating compartment. That is, the automatic water supply device 71 may be mounted on one of the doors 31 and 32 to open and close the refrigerating compartment. Therefore, water stored in the bucket 170 of the automatic water supply device 71 may be cooled by cold air in the refrigerating compartment.

The door 31 may include a front plate 41, a rear plate 44, an upper cap 42, and a lower cap 43. An insulation space is formed between the front plate 41, the rear plate 44, the upper cap 42, and the lower cap 43, and the insulation material (not shown) may be disposed in the insulation space. A foam insulation material made of urethane may be used as the insulation material. Also, a vacuum insulation material may be used together with the foam insulation material as the insulation material.

The front plate 41 may form a front surface and opposite surfaces of the door 31. The rear plate 44 may form a rear surface 46 of the door 31. The rear surface 46 of the rear plate 44 may face the storage compartment 21.

The rear plate 44 may include a dyke 50 protruding from an edge of the rear surface 46 toward the storage compartment 21 to form an accommodation space 47. The dyke 50 may include an upper dyke part 51 formed at an upper edge thereof, a lower dyke part 52 formed at a lower edge thereof, a first side dyke part 53 and a second side dyke part 54 formed at opposite side edges thereof.

By the rear surface 46 of the door 31, an inner surface 51*a* of the upper dyke part 51, an inner surface 52*a* of the lower dyke part 52, an inner surface 53*a* of the first side dyke part 53, and an inner surface 54*a* of the second side dyke part 54, the accommodation space 47 may be formed such that a rear side thereof is open.

A dyke bead 56*a* for coupling of the door basket 60 and a dyke bead 57*a* for coupling of the water supply case 80 may be formed to protrude on the inner surface 53*a* of the first side dyke part 53. A side fastening hole 58 to which a first fastening member S1 for coupling with the water supply case 80 is fastened may be formed on the inner surface 53*a* of the first side dyke part 53. Also, a passing hole 55 (FIG. 7) to allow an electric wire and a hose connected to the automatic water supply device 71 to pass may be formed on the inner surface 53*a* of the first side dyke part 53.

A dyke bead 56*b* for coupling of the door basket 60 and a dyke bead 57*b* for coupling of the door basket 62 (FIG. 9) may be formed to protrude on the inner surface 54*a* of the second side dyke part 54.

A lower fastening hole 59 to which a second fastening member S2 for coupling with the water supply case 80 is fastened may be formed on the inner surface 52*a* of the lower dyke part 52.

In an embodiment of the disclosure, the upper dyke part 51, the lower dyke part 52, the first side dyke part 53, and the second side dyke part 54 protrude from the rear surface 46 to different lengths, but unlike this, they may protrude from the rear surface 46 to the same length.

The water supply case 80 of the automatic water supply device 71 may be accommodated in the accommodation space 47. The water supply case 80 may be coupled to the dyke 50 to be accommodated in the accommodation space 47. Specifically, the water supply case 80 may be coupled to the first side dyke part 53 and the lower dyke part 52 of the dyke 50.

The water supply case 80 may be temporarily fixed to the dyke 50 through the dyke bead 57*b*, and then may be firmly coupled to the dyke 50 through the first fastening member 51 and the second fastening member S2. A coupling structure of the water supply case 80 will be described later.

The water supply case 80 may include a main case 81, a case cover 100 coupled to an upper portion of the main case 81, and a tray 110 coupled to a lower portion of the main case 81.

The bucket mounting space 87 in which the bucket 170 is detachably mounted may be formed in the main case 81. The bucket mounting space 87 may be formed to be recessed so that one side is open. A bucket support 86 to support the bucket 170 may be formed below the bucket mounting space 87 of the main case 81.

An upper fastening hole 90 for coupling with the case cover 100 may be formed at an upper part 82 of the main case 81. A cover fastening hole 101 corresponding to the upper fastening hole 90 is formed on the case cover 100, and a fastening member S3 may be fastened to the upper fastening hole 90 and the cover fastening hole 101. An upper fastening cap 102 may be coupled to the cover fastening hole 101 to prevent the fastening member S3 from being exposed.

A bucket sensor 120 to detect whether the bucket 170 is mounted in the bucket mounting space 87 may be provided at the upper portion 82 of the main case 81. The bucket sensor 120 may be configured as a Hall sensor. The bucket sensor 120 may detect a magnet 188 (FIG. 10) provided in the bucket 170. The bucket sensor 120 may not be exposed to the outside by being covered by the case cover 100.

The bucket sensor 120 may detect whether the bucket 170 is mounted in the bucket mounting space 87, and may transmit a signal for controlling the control valve 76 to block water supply to the bucket 170 to the controller 20 when the bucket 170 is not mounted. Accordingly, the water supply to the bucket 170 may be prevented from proceeding in a state in which the bucket 170 is not mounted.

A fitting member 150 connected to the water supply flow path 72 to guide water supplied from the water supply flow path 72 to the bucket 170 may be provided at the upper portion 82 of the main case 81. A water outlet hole 96 (FIG. 10) through which the fitting member 150 passes may be formed at the upper portion 82 of the main case 81. The fitting member 150 may not be exposed to the outside by being covered by the case cover 100.

The main case 81 may include a stopper 97 provided above the bucket mounting space 87 to reduce the movement of the bucket 170 supported on the bucket support 86. The stopper 97 is formed of a rubber material to buffer the movement of the bucket 170.

The water level sensor 130 may be installed at a rear portion 83 of the main case 81. However, the position of the water level sensor 130 is not limited thereto, and the water level sensor 130 may be disposed at any position as long as the water level sensor 130 may detect the water level in the bucket 170.

The water level sensor 130 may be provided as a capacitive sensor capable of detecting a water level in the bucket 170 by detecting a capacitance changing depending on a liquid level in the bucket 170. The water level sensor 130 as above may detect the water level in the bucket 170 by being in contact with the bucket 170 without being in contact with the liquid in the bucket 170.

The water level sensor 130 may include a sensor bracket 131 fixed to the main case 81, a sensor part 132 to detect a water level in the bucket 170, and an elastic member 133 to press the sensor part 132 toward the bucket 170.

The sensor part 132 may be disposed to come into contact with the bucket 170 when the bucket 170 is mounted in the bucket mounting space 87. The sensor part 132 may be provided to be movable in a front-rear direction with respect to the sensor bracket 133.

The water level sensor 130 may transmit a signal for controlling the control valve 76 to block the water supply to the bucket 170 to the controller 20 (FIG. 18) when water is stored in the bucket 170 in a predetermined amount. On the other hand, the water level sensor 130 may transmit a signal for controlling the control valve 76 to proceed with the water supply to the bucket 170 to the controller 20 when water less than the predetermined amount is stored in the bucket 170.

The tray 110 may be provided at the lower portion of the main case 81. The tray 110 may collect water flowing out of the bucket 170. That is, when water is excessively supplied to the bucket 170 and the bucket 170 overflows with water, the tray 110 may collect the water overflowed from the bucket 170.

When water overflows from the bucket 170, the water overflowed from the bucket 170 may be guided to the tray 110 through a drain guide hole 99 (FIG. 10) of the main case 81.

The tray 110 may be provided with an overflow sensor 140 to detect water collected in the tray 110. The overflow sensor 140 may transmit a signal for controlling the control valve 76 to block the water supply to the bucket 170 to the controller 20 when detecting that the predetermined amount of water is collected in the tray 110.

A drain hole 111 to discharge water collected in the tray 110 to the outside may be formed on the tray 110. The drain hole 111 may be provided with a plug 112 to open and close the drain hole 111. The plug 112 is provided to close the drain hole 111 in a normal state, and when the plug 112 is separated from the drain hole 111, the water collected in the tray 110 may be discharged to the outside.

A case bead groove 88 (FIG, 6) may be formed on one side portion 84 of the main case 81. The dyke bead 57*a* of the first side dyke part 53 may be inserted and supported in the case bead groove 88. That is, as the dyke bead 57*a* is inserted and supported in the case bead groove 88, the water supply case 80 may be temporarily fixed to the dyke 50.

A first fastening part 91 on which a first fastening hole 92 is formed may be provided at one side of the upper portion 82 of the main case 81. The first fastening hole 92 is formed at a position corresponding to the side fastening hole 58 formed on the inner surface 53*a* of the first side dyke part 53, and the first fastening member S1 may be fastened to the first fastening hole 92 and the side fastening hole 58.

When the case cover 100 is coupled to the upper portion of the main case 81, the first fastening member S1 may not be exposed to the outside by being covered by the case cover 100.

A second fastening part 93 on which a second fastening hole 94 is formed may be provided at one side of the lower portion of the main case 81. The second fastening hole 94 is formed at a position corresponding to the lower fastening hole 59 formed on the inner surface 52*a* of the lower dyke part 52, and the second fastening member S2 may be fastened to the second fastening hole 94 and the lower fastening hole 59. A lower fastening part cap 95 may be coupled to the second fastening part 93 to prevent the second fastening member S2 from being exposed to the outside.

In this way, the water supply case 80 may be temporarily fixed by the coupling of the case bead groove 88 and the dyke bead 57*a* and then may be firmly fixed in place by the fastening of the plurality of fastening members S1 and S2.

A case bead 89 (FIG. 7) for coupling the door basket 62 may protrude from a side portion 85 of the main case 81 opposite to the side portion 84 on which the case bead groove 88 is formed. The case bead 89 may be inserted into a basket bead groove 63*a* of the door basket 62.

That is, the door basket 62 may be provided with the basket bead groove 63*a* and a basket bead groove 63*b* on opposite sides, respectively, the basket bead groove 63*a* on one side may be supported by the case bead 89 of the water supply case 80, and the basket bead groove 63*b* on the other side may be supported by the dyke bead 57*b* of the dyke 50.

With this configuration, the door basket 62 may be disposed adjacent to one side of the water supply case 80 of the automatic water supply device 71, and a space inside the rear surface of the door 31 may be efficiently utilized. In addition, the door basket 62 may be easily mounted.

The other door basket 60 may be mounted above the automatic water supply device 71. The door basket 60 is provided with a basket bead groove 61*a* and a basket bead groove 61*b* on opposite sides, respectively, and the basket bead grooves 61*a* and 61*b* may be coupled to the dyke beads 56*a* and 56*b* of the dyke 50, respectively.

Figure 12:
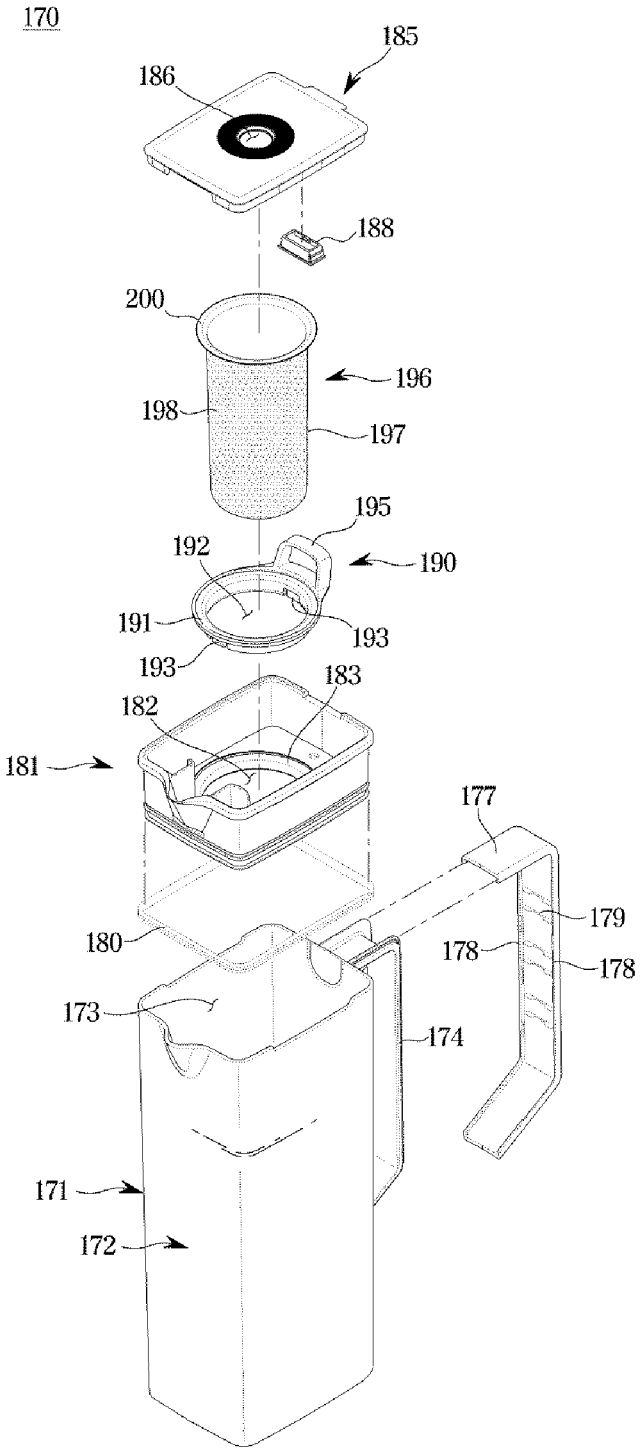
FIG. 12 is an exploded view illustrating the bucket of the refrigerator according to an embodiment of the disclosure.
Figure 13:
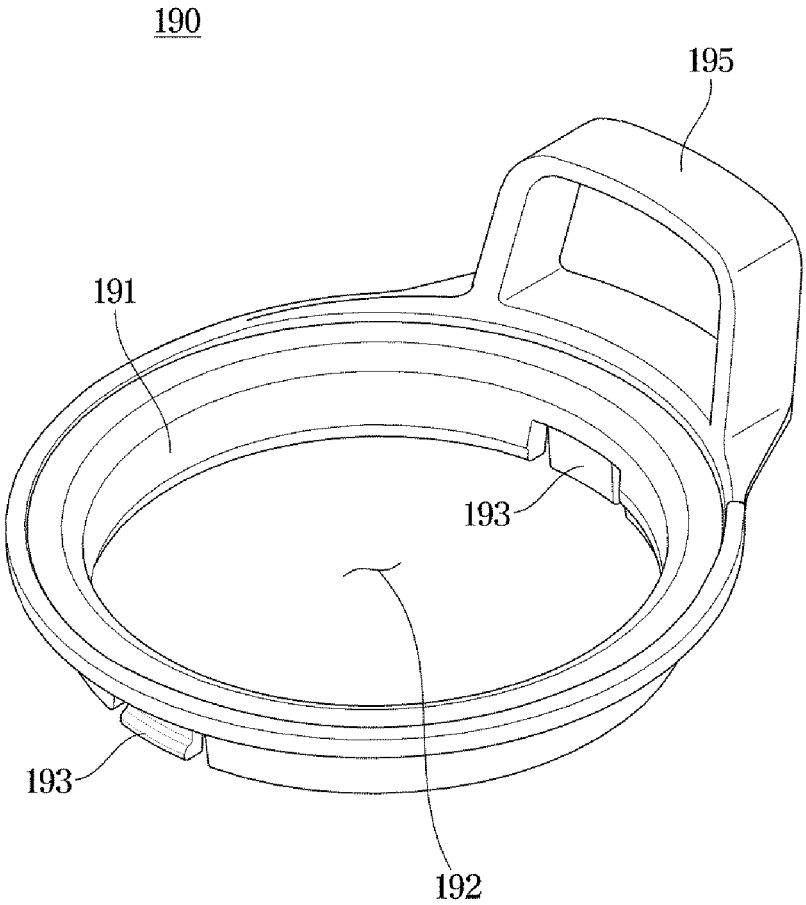
FIG. 13 is a view illustrating an infuser mount of the bucket of the refrigerator according to an embodiment of the disclosure.
Figure 14:
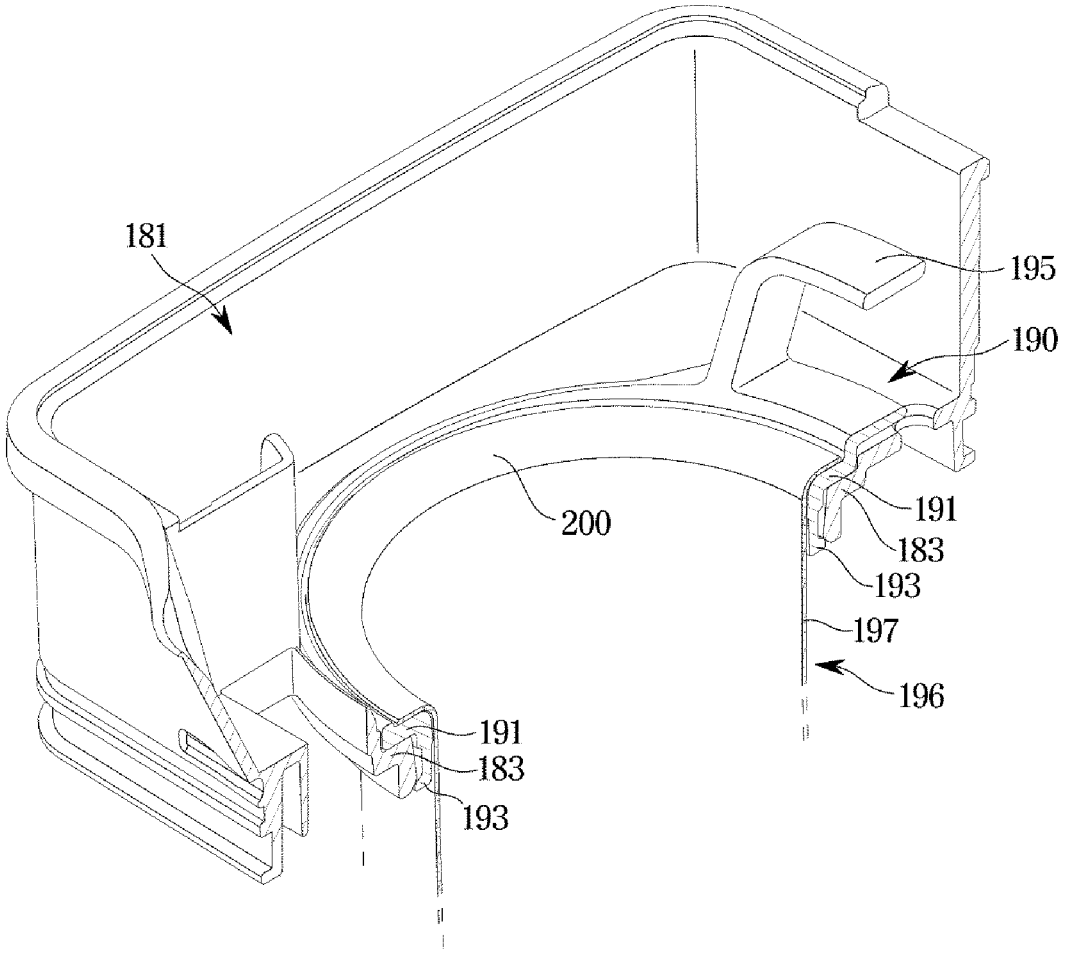
FIG. 14 is a view illustrating a cross section of the bucket of the refrigerator according to an embodiment of the disclosure.
Figure 15:
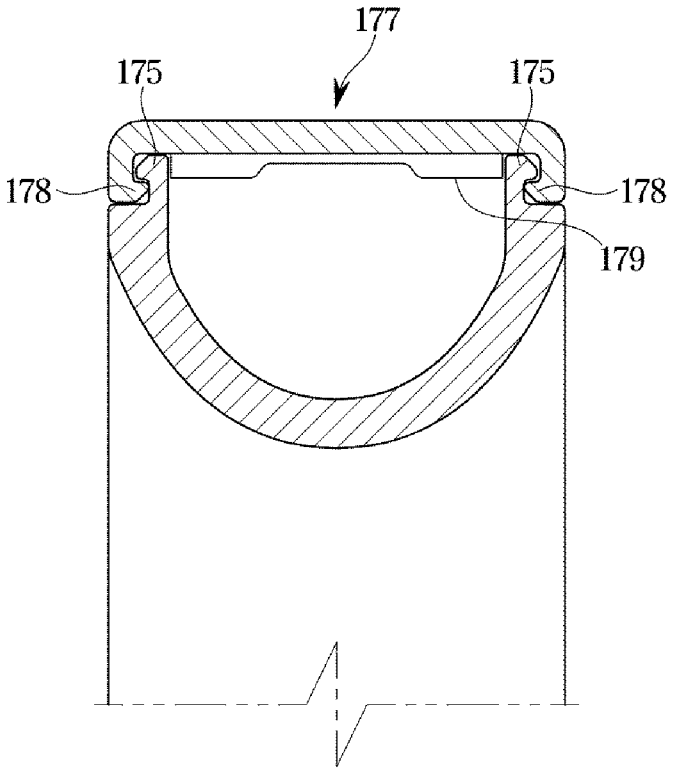
FIG. 15 is a cross-sectional view illustrating a bucket handle of the bucket of the refrigerator according to an embodiment of the disclosure.
Figure 16:
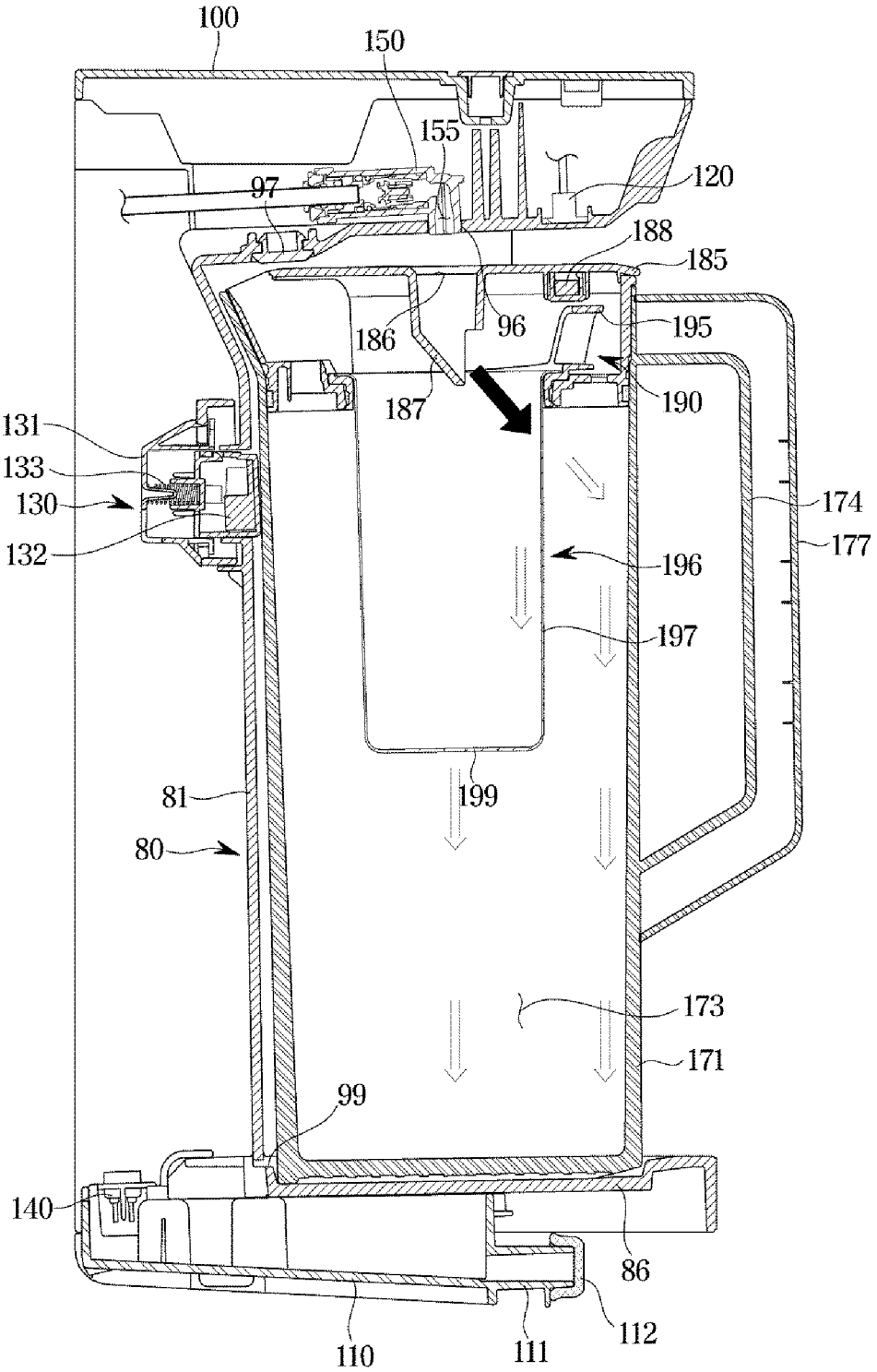
FIG. 16 is a view illustrating a process in which water is guided by a guide of the bucket of the refrigerator according to an embodiment of the disclosure.

FIG. 12 is an exploded view illustrating the bucket of the refrigerator according to an embodiment of the disclosure. FIG. 13 is a view illustrating an infuser mount of the bucket of the refrigerator according to an embodiment of the disclosure. FIG. 14 is a view illustrating a cross section of the bucket of the refrigerator according to an embodiment of the disclosure. FIG. 15 is a cross-sectional view illustrating a bucket handle of the bucket of the refrigerator according to an embodiment of the disclosure. FIG. 16 is a view illustrating a process in which water is guided by a guide of the bucket of the refrigerator according to an embodiment of the disclosure.

Referring to FIGS. 12 to 16, the bucket 170 may include a bucket body 171 to store water, a bucket cover 185 coupled to an upper side of the bucket body 171, an infuser 196 provided to accommodate and brew tea leaves, tea bags, or the like, and an infuser mount 190 to easily attach and detach the infuser 196 to and from the bucket body 171.

The bucket body 171 may include a bucket main body 172 having a bucket space 173 to store water, and a bucket upper body 181 coupled to an upper side of the bucket main body 172 and having a bucket opening 182 in communication with the bucket space 173.

The bucket main body 172 may be formed of a transparent material so that water stored therein may be seen. The bucket main body 172 may be provided with a bucket handle 174 so that a user may easily grip the bucket handle 174 to attach or detach the bucket main body 172 to or from the water supply case 80. The bucket handle 174 may be formed integrally with the bucket main body 172.

A handle cover 177 may be coupled to the bucket handle 174, and for this purpose, locking protrusions 175 are formed at opposite ends of the bucket handle 174, and an outer rib 178 formed to be caught on the outside of the locking protrusion 175 and an inner rib 179 formed to be caught on the inside of the locking protrusion 175 may be formed on the handle cover 177.

The bucket upper body 181 may be coupled to the bucket main body 172 in a force-fitting manner. A sealing member 180 may be provided between the bucket main body 172 and the bucket upper body 181 to prevent a leak of stored water. The sealing member 180 may be formed of a material having elasticity such as rubber.

The bucket upper body 181 may include the bucket opening 182 in communication with the bucket space 173. The infuser 196 may be inserted into the bucket space 173 through the bucket opening 182. A support part 183 on which the infuser mount 190 is seated may be formed around the bucket opening 182. The bucket upper body 181 may have an open upper side to facilitate mounting of the infuser 196.

The infuser 196 may be formed to accommodate tea leaves, tea bags, or the like. The infuser 196 may include a sidewall 197 having a cylindrical shape and a bottom 199 formed on a lower end of the sidewall 197. Infuser holes 198 may be formed on the sidewall 197 to allow water to pass through the sidewall 197. An infuser rim 200 may be formed on an upper end of the sidewall 197 to protrude outward in a radial direction.

The infuser mount 190 may include a mount frame 191 having a mount opening 192 into which the infuser 196 is inserted, and a mount handle 195 protruding from the mount frame 191. When the infuser 196 is inserted into the mount opening 192 of the infuser mount 190 from the top to the bottom, a lower surface of the infuser rim 200 may be seated on an upper surface of the mount frame 191.

The mount frame 191 may be elastically coupled to the support part 183 of the bucket body 171 to prevent the infuser mount 190 from being easily separated from the bucket body 171. To this end, an elastic hook 193 coupled to the support part 183 of the bucket body 171 may be formed on the mount frame 191.

As the user holds the mount handle 195 of the infuser mount 190 in a state in which the infuser 196 is seated on the infuser mount 190 and seats the mount frame 191 of the infuser mount 190 on the support part 183 of the bucket upper body 181, the infuser 196 may be mounted on the bucket 170. Even when separating the infuser 196 from the bucket 170, the user may easily separate the infuser 196 after holding the mount handle 195 of the infuser mount 190.

The bucket cover 185 may be formed to cover the open upper side of the bucket upper body 181. The bucket cover 185 may include an inlet 186 to allow water to be introduced into the bucket body 171. When the bucket 170 is mounted in the bucket mounting space 87, the inlet 186 may be positioned to correspond to the water outlet hole 96 formed on an upper surface of the main case 81 and an outlet 155 of the fitting member 150 (FIG. 10).

The bucket cover 185 may include a guide 187 formed to be inclined to guide water introduced through the inlet 186 toward the sidewall 197 of the infuser 196. The guide 187 may be formed below the inlet 186.

Water introduced through the inlet 186 may be guided to the sidewall 197 of the infuser 196 by the guide 187 or may be guided to a sidewall of the bucket body 171 through the infuser holes 198. Accordingly, the water introduced through the inlet 186 may be prevented from directly falling to the bottom 199. Therefore, noise generated when the water introduced through the inlet 186 falls directly to the bottom 199 may be prevented.

The magnet 188 may be mounted on a bottom of the bucket cover 185. The magnet 188 may be disposed at a position corresponding to the bucket sensor 120 when the bucket 170 is mounted in the bucket mounting space 87.

Figure 17:
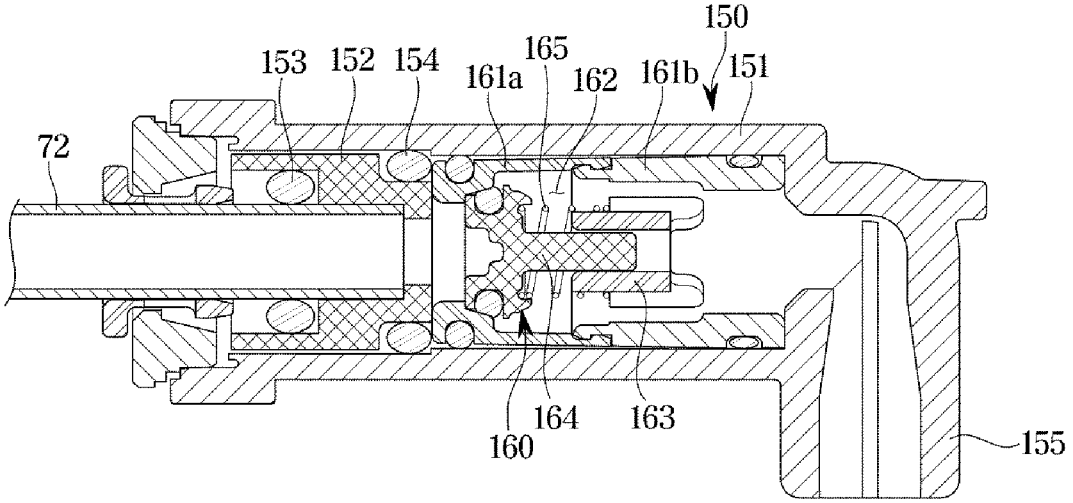
FIG. 17 is a cross-sectional view illustrating a fitting member of the refrigerator according to an embodiment of the disclosure.

FIG. 17 is a cross-sectional view illustrating a fitting member of the refrigerator according to an embodiment of the disclosure.

The fitting member 150 may be connected to the water supply flow path 72 to guide water supplied from the water supply flow path 72 to the bucket 170. The water supply flow path 72 may be formed of a hose or tube.

The fitting member 150 may have a substantially L shape. The fitting member 150 may include a fitting body 151, a connection part 152 to which the water supply flow path 72 is connected, a first O-ring 153 to seal between the water supply flow path 72 and the connection part 152, a second O-ring 154 to seal between the connection part 152 and the fitting body 151, and the outlet 155 to guide water introduced into the fitting member 150 to the bucket 170. A separate part such as a nozzle is not coupled to the outlet 155, and water flowing out from the outlet 155 may fall down and be supplied to the bucket 170.

A check valve 160 may be installed inside the fitting member 150 to check for clogging and leak of the water supply flow path 72.

The check valve 160 may be provided as a mechanical type valve operated by a hydraulic pressure. That is, the check valve 160 may include valve housings 161*a* and 161*b* installed inside the fitting member 150 and having a valve flow path 162 therein, a valve body 164 movably disposed inside the valve flow path 162 so as to open and close the valve flow path 162 depending on a pressure in the water supply flow path 72, a valve seat 163 on which the valve body 164 is seated, and an elastic member 165 to elastically support the valve body 164 so that the valve body 164 closes the valve flow path 162.

When water or air is supplied to the water supply flow path 72, the pressure in the water supply flow path 72 increases and the valve body 164 moves toward the outlet 155, so that the valve flow path 162 may be opened. Conversely, when the pressure in the water supply flow path 72 is equal to or less than an external pressure, the valve body 164 may move toward the connection part 152 by an elastic force of the elastic member 165, so that the valve flow path 162 may be closed.

By applying a positive pressure and a negative pressure to the water supply flow path 72, the water supply flow path 72 may be checked for clogging and leak.

That is, when a positive pressure is applied to an inlet of the water supply flow path 72 for a predetermined time in a state in which the flow path switching valve 75 and the control valve 76 on the water supply flow path 72 are opened and then the pressure in the water supply flow path 72 increases above the reference value or the reference speed, it may be determined that there is a clogging portion in the water supply flow path 72.

Contrary, when a negative pressure is applied to the inlet of the water supply flow path 72 for a predetermined time in the state in which the flow path switching valve 75 and the control valve 76 on the water supply flow path 72 are opened and then the pressure in the water supply flow path 72 decreases above a reference value or a reference speed, it may be determined that there is a leak portion in the water supply flow path 72.

FIG. 18 is a control block diagram of the refrigerator according to an embodiment of the disclosure. As shown in FIG. 18 and described above, the refrigerator may include a bucket sensor 120, a water level sensor 130, an overflow sensor 140, a controller 20 and a control valve 76.

As is apparent from the above, according to an embodiment of the disclosure, an automatic water supply device can be easily and firmly installed on a door of a refrigerator.

Further, according to an embodiment of the disclosure, the usability of the automatic water supply device can be improved.

While the disclosure has been particularly described with reference to exemplary embodiments, it should be understood by those of skilled in the art that various changes in form and details may be made without departing from the spirit and scope of the disclosure.

What is claimed is:

1. A refrigerator comprising:

a main body having a storage compartment;

a door rotatable with respect to the main body to open and close the storage compartment, the door including;

an upper dyke part, a lower dyke part, a first side dyke part, a second side dyke part, and an accommodation space formed on a rear side of the door surrounded by the upper dyke part, the lower dyke part, the first side dyke part and the second side dyke part, and a dyke bead to protrude from an inner surface of the first side dyke part;

a door basket arrangeable in the accommodation space to store an item;

a case mountable on the rear side of the door while accommodated in the accommodation space, the case including a bucket mounting space; and a case cover configured to be coupled to an upper portion of the case, and wherein the case includes:

a case bead groove configured to be coupled to the dyke bead of the door such that while the case bead groove is coupled to the dyke bead, the case bead groove is supported by the dyke bead of the door;

a first fastening part, formed at the upper portion of the case, configured to be coupled to the first side dyke part, a second fastening part, formed at a lower portion of the case, configured to be coupled to the lower dyke part, wherein the first fastening part is covered by the case cover while the case cover is coupled to the upper portion of the case, and wherein the second fastening part is covered by the door basket while the door basket is arranged in the accommodation space of the door.

2. The refrigerator according to claim 1, wherein the first fastening part includes a first fastening hole, the second fastening part includes a second fastening hole, and the door includes:

a side fastening hole corresponding to the first fastening hole and formed on the inner surface of the first side dyke part, and a lower fastening hole corresponding to the second fastening hole formed on an inner surface of the lower dyke part.

3. The refrigerator according to claim 2, further comprising:

a first fastening member provided to be fastened to the first fastening hole and the side fastening hole to couple the case to the first side dyke part, and a second fastening member provided to be fastened to the second fastening hole and the lower fastening hole to couple the case to the lower dyke part.

4. The refrigerator according to claim 3, further comprising:

a fastening part cap configured to be coupled to the second fastening part to prevent the second fastening member from being exposed.

5. The refrigerator according to claim 1, wherein while the case and the door basket are accommodated in the accommodation space, the case and the door basket are coupled to each other along a horizontal direction of the door.

6. The refrigerator according to claim 5, wherein the door basket includes a basket bead groove formed on one side of the door basket facing the case, and the case includes a case bead formed to protrude from the case to support the door basket while the case bead is inserted into the basket bead groove of the door basket.

7. The refrigerator according to claim 6, wherein the case bead is arranged below the second fastening part.

8. The refrigerator according to claim 5, wherein the dyke bead is a first dyke bead, the door basket includes a basket bead groove formed on one side of the door basket facing the second side dyke part, and the door includes a second dyke bead formed to protrude on an inner surface of the second side dyke part to support the door basket while the second dyke bead is inserted into the basket bead groove of the door basket.

9. The refrigerator according to claim 1, further comprising:

a bucket attachable to and detachable from the bucket mounting space of the case, and a water level sensor provided to detect a level of water in the bucket.

10. The refrigerator according to claim 9, further comprising:

a tray provided at the lower portion of the case to collect the water which flows out of the bucket, wherein the tray includes:

a drain hole provided to discharge the water collected in the tray; and a plug provided to open and close the drain hole.

11. The refrigerator according to claim 10, wherein the case includes:

a bucket support formed below the bucket mounting space to support the bucket; and a stopper formed of a rubber material and provided above the bucket mounting space to reduce a movement of the bucket while the bucket is supported by the bucket support.

12. The refrigerator according to claim 9, further comprising:

a water supply flow path provided to guide water supplied from a water supply source to the bucket, and a control valve provided to open and close the water supply flow path depending on the level of the water in the bucket detected by the water level sensor.

13. The refrigerator according to claim 12, further comprising:

a fitting member connected to the water supply flow path to guide the water supplied from the water supply flow path to the bucket, and the fitting member is disposed on an upper surface of the case to pass through a water outlet hole formed on the case.

14. The refrigerator according to claim 13, further comprising:

a check valve installed inside the fitting member to allow clogging and leak with respect to the water supply flow path to be checked.

15. The refrigerator according to claim 14, wherein the check valve comprises:

a valve housing installed inside the fitting member, the valve housing having a valve flow path; and a valve body moveable inside the valve flow path to open and close the valve flow path depending on a pressure in the water supply flow path.

* * * * *